US005699034A

United States Patent [19]

Tsao

[11] Patent Number: 5,699,034

[45] Date of Patent: Dec. 16, 1997

[54] THERMOSTAT CONTROLLED PROBE-TYPE PLUG HAVING A STOPPING MEMBER TO PREVENT SWITCH CLOSING UNDER LOW TEMPERATURES

[75] Inventor: Kai-Hwa Tsao, Taipei, Taiwan

[73] Assignee: Etowah Taiwan Enterprise Co., Ltd., Taipei, Taiwan

[21] Appl. No.: 651,863

[22] Filed: May 21, 1996

[51] Int. Cl.[6] ..... H01H 37/48

[52] U.S. Cl. ..... 337/394; 337/348

[58] Field of Search ..... 337/354, 348, 337/383, 392–394, 333; 219/449, 464, 512

[56] References Cited

U.S. PATENT DOCUMENTS 5,270,799 12/1993 Rose ..... 337/354

*Primary Examiner*—Leo P. Picard
*Assistant Examiner*—Jayprakash N. Gandhi

[57] ABSTRACT

A thermostat controlled probe-type plug includes a heat detecting probe made from dual-metal. This heat detecting probe has a hollow tube and a metal rod is disposed therein. A swing arm is disposed at the open end of the hollow tube. The outer end of the metal rod is fixed to the swing arm at a suitable position. A fixing arm is disposed above the hollow tube. An elastic plate switch is disposed under the fixing arm. This elastic plate switch includes a first elastic plate and a second elastic plate. The end portion of the first elastic plate is above the end portion of the fixing arm. A biasing rod is disposed on the fixing arm and a knob is attached to the other end of the biasing rod. The biasing rod is pressed against onto the elastic plate switch. By screwing down the knob, the biasing rod can press down the second elastic plate to close or open the switch. At least one stopping post is provided at the bottom of the casing. The stopping post is located below the first elastic plate of the switch. By this arrangement, the first elastic plate will not move down under extremely low temperatures as it is blocked by the stopping post. The switch is therefore kept from becoming closed.

3 Claims, 5 Drawing Sheets

THERMOSTAT CONTROLLED PROBE-TYPE PLUG HAVING A STOPPING MEMBER TO PREVENT SWITCH CLOSING UNDER LOW TEMPERATURES

BACKGROUND OF THE INVENTION

This invention relates to a plug and, more particularly, to a thermostat controlled probe-type plug. The elastic plate of the switch is blocked by a stopping post to keep the switch biased in an opened condition. The elastic plate will not bounce back under low temperatures. Accordingly, the switch will not resume automatically.

In our modern life, many electric heaters or electric ovens are used for warmth and cooking. Since the power consumption, both on current as well as power, of the electric heater and oven are comparatively high, and in order to avoid damaging these appliances due to overheating or overloading, a thermostat breaking device is incorporated in the power plug. Once the preset temperature is reached, the power supply is blocked to prevent the appliances from being damaged as the temperature keeps on rising. Most important, a potential fire can be therefore avoided.

As shown in FIG. 5, the conventional thermostat breaking device has a heat detecting probe (b) made from dual-metal within its casing (a). This heat detecting probe (b) has a hollow tube (c) and a metal rod (d) is disposed therein. A swing arm (e) is disposed at the open end of the hollow tube (c). The outer end of the metal rod (d) is fixed to the swing arm (e) at a suitable position. A fixing arm (f) is disposed above the hollow tube (c). An elastic plate switch (g) is disposed under the fixing arm (f). This elastic plate switch (g) comprises a first elastic plate (g1) and a second elastic plate (g2). The end portion of the first elastic plate (g1) is above the end portion of the fixing arm (f). A biasing rod (h) is disposed on the fixing arm (f) and a knob (i) is attached to the other end of the biasing rod (h). The biasing rod (h) is pressed against onto the elastic plate switch (g). By screwing down the knob (i), the biasing rod (h) can press down the second elastic plate (g2) to close or open the switch (g). On the other hand, the downward displacement of the second elastic plate (g2) can be used to set the temperature.

When the dual-metal probe (b) is heated, since the expanding coefficients between the hollow tube (c) and the metal rod (d) are different, the stretching of those two elements after being heated are different as well. (Normally, the expanding coefficient of the hollow tube (c) is larger than that of the metal rod (d).) By this arrangement, the swing arm (e) may move upward or downward. When the temperature rises, the swing arm (e) moves upward. Accordingly, the first elastic plate (g1) of the switch (g) is moved upward. As a result, the first and second elastic plates (g1) and (g2) are separated, and the power supply is blocked. On the contrary, when the temperature lowers down, the swing arm (e) moves downward, the first and second elastic plates (g1) and (g2) of the switch (g) resume contact. Power supply resumes and the heater is heated again.

In some countries located in Frigid Zone, the super-low temperature condition is frequently experienced. The outside temperature lowers to an extremely low level. In light of this, the knob (i) has been adjusted to make the biasing rod (h) move the switch (g) and the first elastic plate (g1) is resting on the swing arm (e). The first and second elastic plates (g1) and (g2) are separated accordingly. Nevertheless, since the temperature is extremely low and the first elastic plate (g1) is resting on the swing arm (e) and the swing arm (e) is connected to the dual-metal detecting probe (b). The detecting probe (b) will still detect the temperature outside. As the expanding coefficient of the hollow tube (c) is larger than that of the metal rod (d), the swing arm (e) will still move down as the temperature goes down. By this arrangement, the first elastic plate (g1) moves down with the swing arm (e). At last, the first and second elastic plates (g1) and (g2) contact each other. The switch (g) is closed to supply power to the heater. As a result, even if the switch (g) is closed, the switch (g) is not resumed to close again because the temperature lowers down. This is very dangerous. If no one lives in the house, a potential risk of fire may happen.

SUMMARY OF THE INVENTION

It is the object of this invention to provide an improved probe-type plug which can be applied to an appliance and solve the disadvantages encountered by the conventional probe-type plug.

In order to achieve the object set forth, the thermostat controlled probe-type plug generally comprises a heat detecting probe made from a dual-metal disposed within its casing. This heat detecting probe has a hollow tube and a metal rod is disposed therein. A swing arm is disposed at the open end of the hollow tube. The outer end of the metal rod is fixed to the swing arm at suitable position. A fixing arm is disposed above the hollow tube. An elastic plate switch is disposed under the fixing arm. This elastic plate switch comprises a first elastic plate and a second elastic plate. The end portion of the first elastic plate is above the end portion of the fixing arm. A biasing rod is disposed on the fixing arm and a knob is attached to the other end of the biasing rod. The biasing rod is pressed against onto the elastic plate switch. By screwing down the knob, the biasing rod can press down the second elastic plate to close or open the switch. At least one stopping post is provided at the bottom of said casing. Said stopping post is located below the first elastic plate of said switch. By this arrangement, the first elastic plate will not move down under extremely low temperatures as it is blocked by said stopping post. The switch is kept from being closed. Accordingly, the risk of overheating or overloaded can be effectively avoided. Power is saved as well.

BRIEF DESCRIPTION OF THE DRAWINGS

The invention will be better understood from the following detailed description taken in conjunction with the accompanying figures of the drawings, wherein.

DETAILED DESCRIPTION OF PREFERABLE EMBODIMENTS

Figure 1:
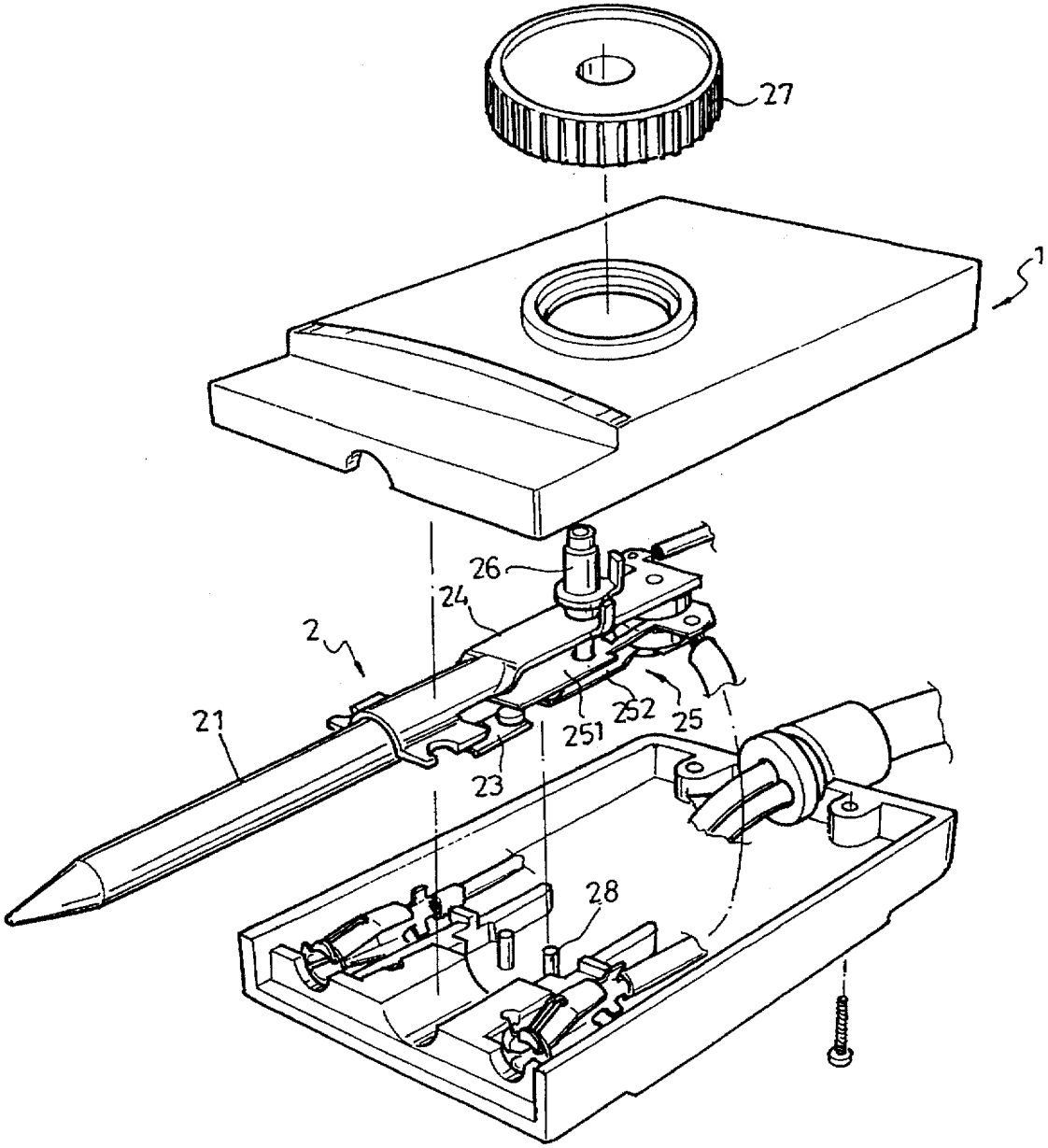
FIG. 1 is an exploded perspective view of the thermostat controlled probe-type plug made according to this invention.

Referring to FIG. 1, the plug generally comprises a casing 1 having a dual-metal probe 2 therein. The dual-metal probe 2 has a hollow tube member 21. A metal rod 22 is disposed with said hollow tube 21. A swing arm 23 is disposed at the open end of said hollow tube 23. The outer end of the metal rod 22 is fixed to the swing arm 23 at a suitable position. The expanding coefficient of said hollow tube 21 is larger than that of said metal rod 22. A fixing arm 24 is disposed above the hollow tube 21. An elastic plate switch 25 is disposed under the fixing arm 24. This elastic plate switch 25 comprises a first elastic plate 251 and a second elastic plate 252. The end portion of the first elastic plate 251 is above the end portion of the fixing arm 24. A biasing rod 26 is disposed on the fixing arm 24 and a knob 27 is attached to the other end of the biasing rod 26. The biasing rod 26 is pressed against onto the elastic plate switch 25. By screwing down the knob 27, the biasing rod 26 can press down the second elastic plate 252 to close or open the switch 25. A stopping post 28 is disposed at least at the casing 1 under the first elastic plate 251 of said elastic switch 25.

Figure 2:
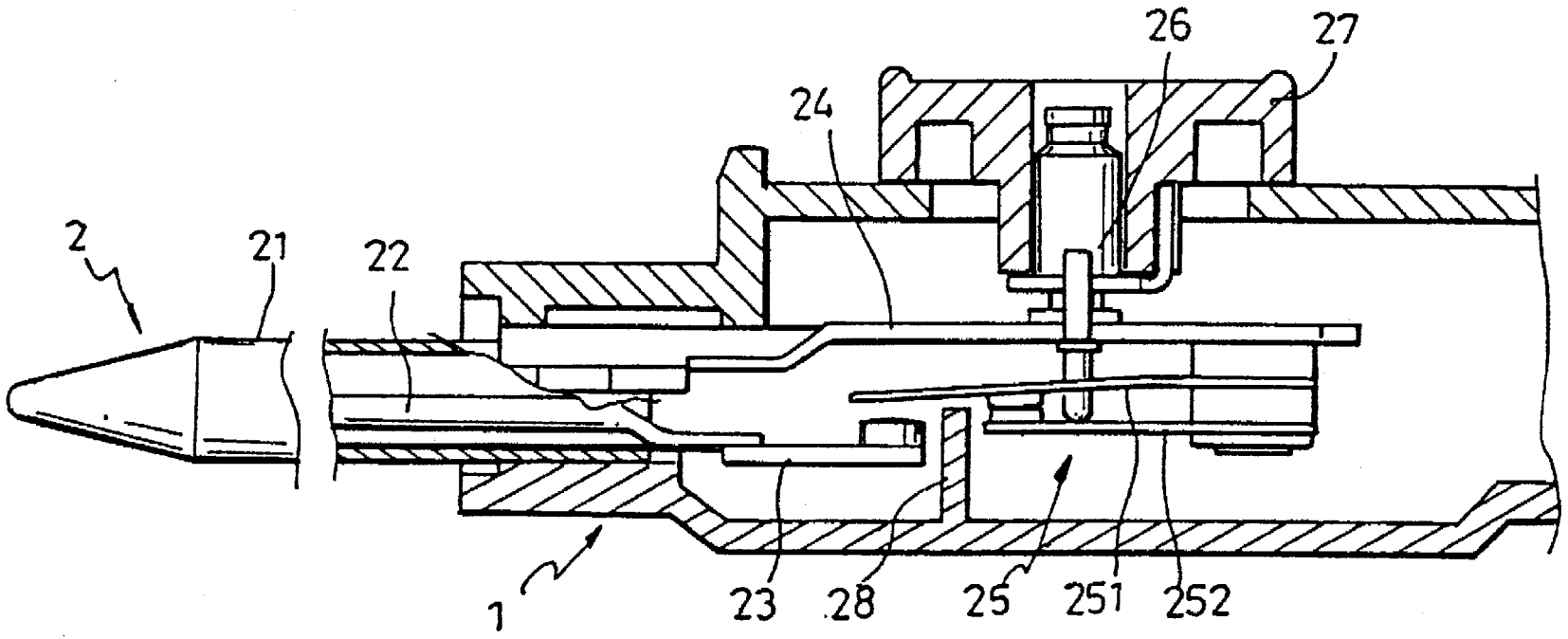
FIG. 2 is cross sectional view of the plug shown in FIG. 1.

Referring to FIG. 2, in normal condition, the user may rotate said knob 27 to press said biasing rod 26 against said switch 25 to set the temperature. In this condition, the switch 25 is closed and the power is supplied to the appliance and the probe 2 is functioning to detect the outside temperature. If the temperature within the housing has reached the preset temperature, the swing arm 23 is moved upward since the expanding coefficient of said hollow tube 21 is larger than what of said metal rod 22, consequently, the extension length of said hollow tube 21 is larger than the extension length of said metal rod 22. When the swing arm 23 is moved upward, the first elastic plate 251 of said switch 25 is moved upward as well. By this arrangement, the first and second elastic plate 251, 252 of said switch 25 will separated from each other. The power supply is blocked and heat is no longer supplied to the appliance.

When the room temperature is lower than the preset temperature, as the retraction of said hollow tube 21 is faster than the metal rod 22, the swing arm 23 is moved downward. Accordingly, the first elastic plate 251 of said switch 25 is moved downward and eventually brought back in contact with said second elastic plate 252. The switch 25 is therefore closed again, and the power supply resumes. The appliance is again supplied heat.

When the appliance is not in use for a long time, the user may rotate the knob 27 to move the biasing rod 26 downward to press against the second elastic plate 252 of said switch 25. By this arrangement, the switch 26 is opened and no power is supplied to the appliance.

When the room temperature is lowered again because of extremely low temperatures outside, and because the probe 2 is always detecting temperature, the hollow tube 21 will keep on retracting to lower the swing arm 23. By the provision of said stopping post 28 disposed under said first elastic plate 251 of said switch 25, the first elastic plate 251 is blocked by said stopping post 28 from further moving downward. By this arrangement, the switch 25 is kept from being closed as the swing arm 23 moves down respect to the low temperature. As a result, an accident can be prevented and power is saved.

Figure 3:
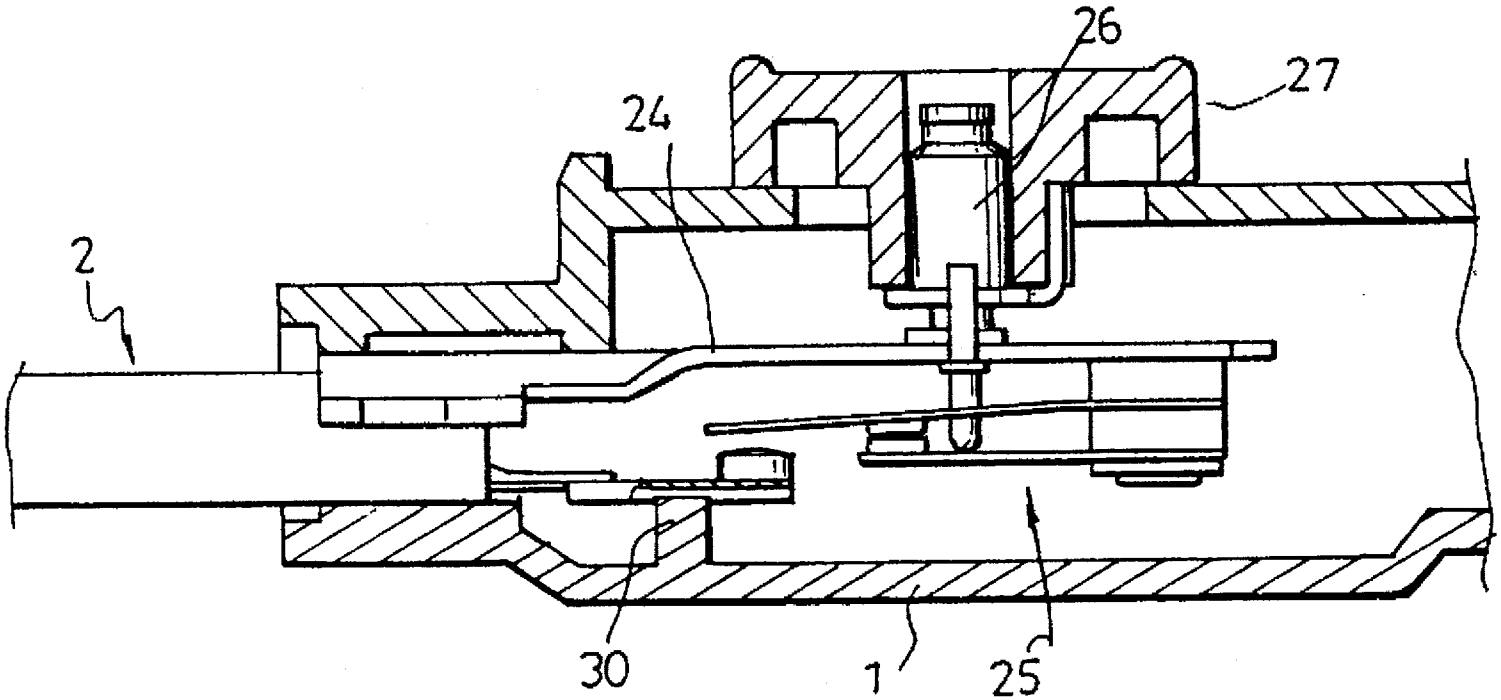
FIG. 3 is similar to FIG. 2 which discloses the second embodiment of the plug made according to the present invention.

Referring to FIG. 3, the stopping post 28 can be designed as a wedge 30 and is disposed under said swing arm 23. When the switch 25 is in an opened condition and the room temperature is very low, the first elastic plate 251 will move down as the swing arm 23 moves down. As said swing arm 23 is stopped by said wedge 30 from moving down. The first and second elastic plates 251, 252 will not contact with each other. The switch 25 is prevented from closing under extremely low temperature.

Figure 4:
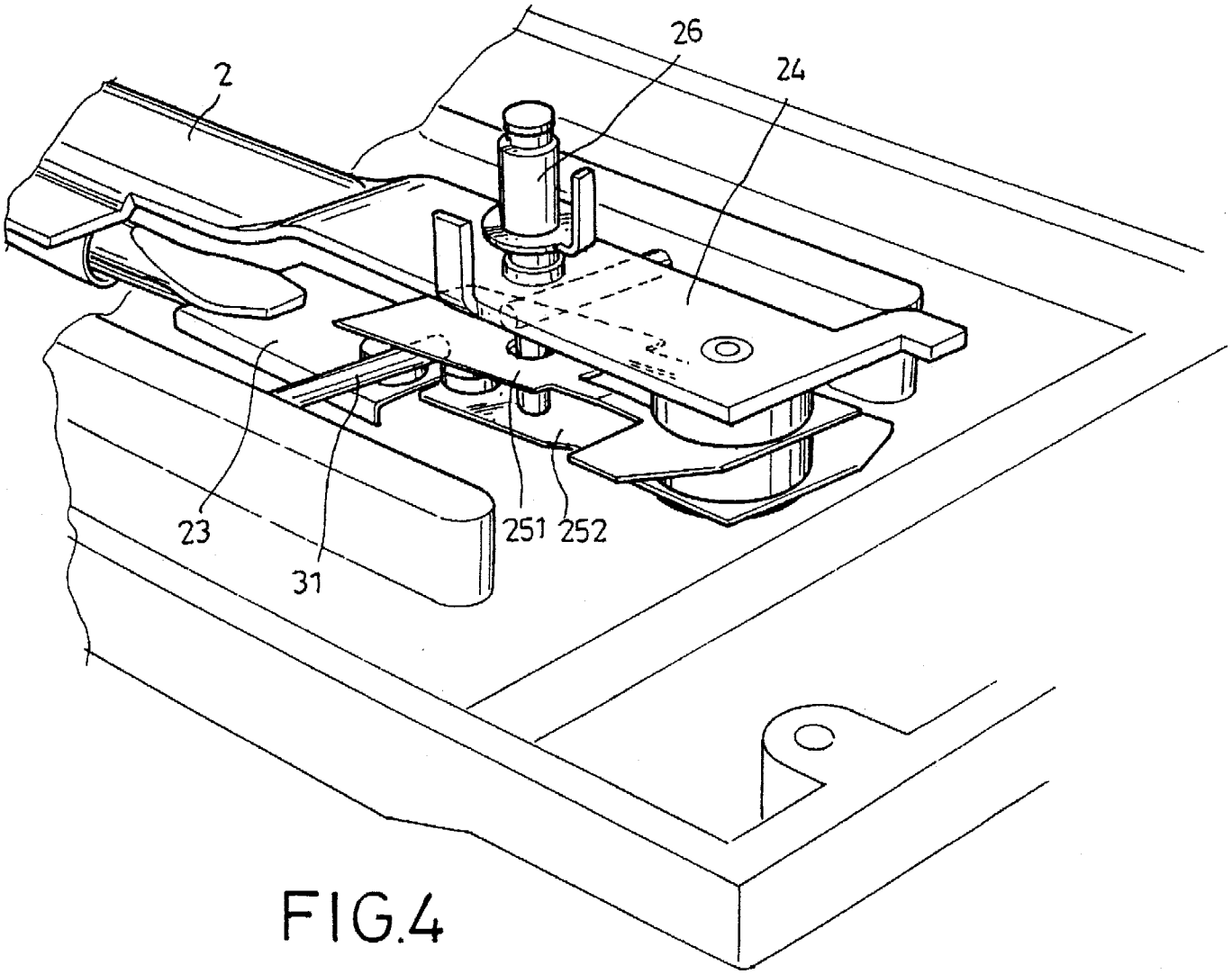
FIG. 4 is an assembled perspective view of the second embodiment shown in FIG. 3.
Figure 5:
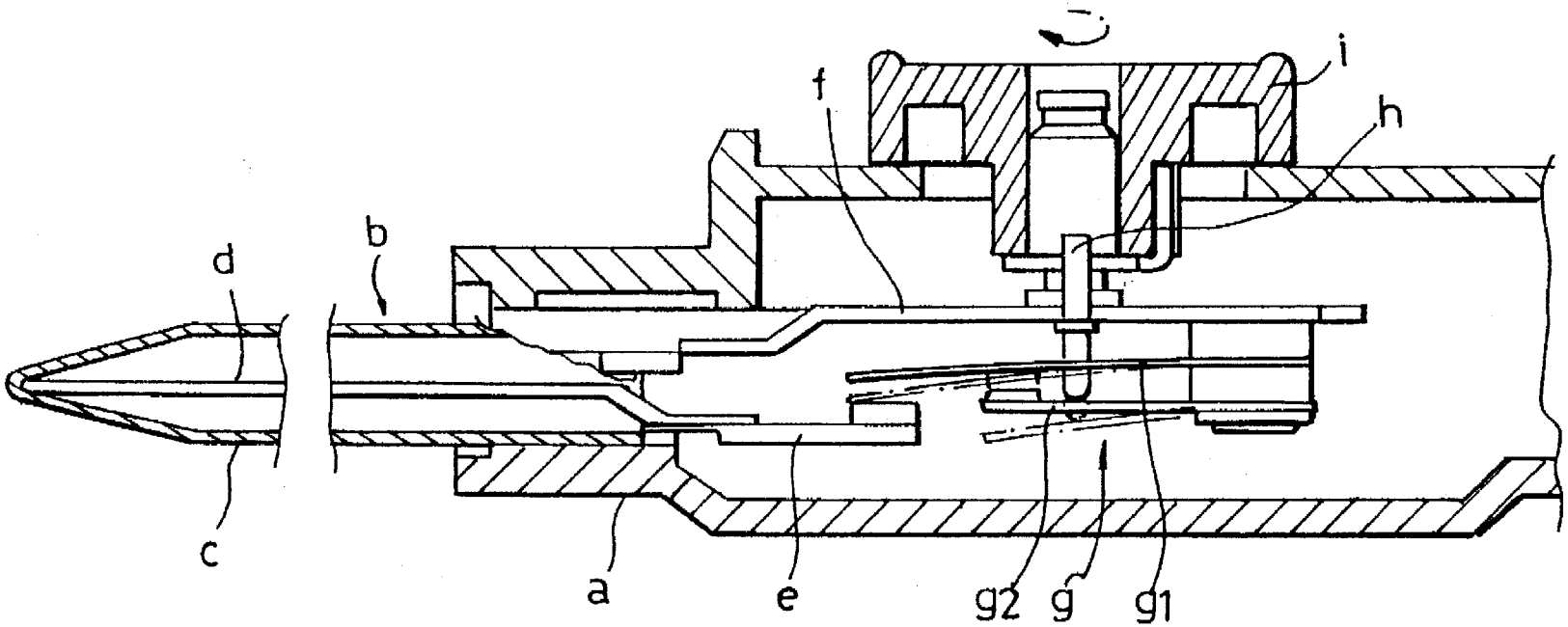
FIG.5 PRIOR ART
FIG. 5 is a cross sectional view of a conventional plug.

Referring to FIG. 4, the stopping post 28 can be designed as a pair of traverse rods 31 which are partially disposed under the first elastic plate 251. By this arrangement, the switch 25 is again prevent from closing during the extremely low temperature.

It will be understood that the invention is not limited to all the specific details described in connection with the preferred embodiment, except as they may be within the scope of the appended claim, and that changes to certain features of the preferred embodiment which do not alter the overall basic function and concept of the invention are contemplated.

I claim:

1. A thermostat controlled probe-type plug, comprising:

a casing;

a heating detecting probe disposed in said casing, said heat detecting probe including a hollow tube and a metal rod disposed in said hollow tube;

a swing arm disposed at an open end of said hollow tube, an outer end of said metal rod being fixed to said swing arm;

a fixing arm disposed above said hollow tube;

an elastic plate switch disposed under said fixing arm, said elastic plate switch including a first elastic plate and a second elastic plate, an end portion of said first elastic plate being above an end portion of said swing arm;

a biasing rod disposed on said fixing arm; and a knob attached to said biasing rod, said biasing rod operating said elastic plate switch by displacing said second elastic plate when said knob is operated, wherein at least one stopping post is provided at a bottom of said casing, said stopping post being located below said first elastic plate of said switch such that said first elastic plate is prevented from downward movement caused by a change in temperature when contacting said stopping post.

2. A thermostat controlled probe-type plug, comprising:

a casing;

a heating detecting probe disposed in said casing, said heat detecting probe including a hollow tube and a metal rod disposed in said hollow tube;

a swing arm disposed at an open end of said hollow tube, an outer end of said metal rod being fixed to said swing arm;

a fixing arm disposed above said hollow tube;

an elastic plate switch disposed under said fixing arm, said elastic plate switch including a first elastic plate and a second elastic plate, an end portion of said first elastic plate being above an end portion of said swing arm;

a biasing rod disposed on said fixing arm; and a knob attached to said biasing rod, said biasing rod operating said elastic plate switch by displacing said second elastic plate when said knob is operated, wherein at least one stopping wedge member is provided under said swing arm, such that said swing arm is prevented from downward movement caused by a change in temperature when contacting said stopping wedge member.

3. A thermostat controlled probe-type plug, comprising:

a casing;

a heating detecting probe disposed in said casing, said heat detecting probe including a hollow tube and a metal rod disposed in said hollow tube;

a swing arm disposed at an open end of said hollow tube, an outer end of said metal rod being fixed to said swing arm;

a fixing arm disposed above said hollow tube;

an elastic plate switch disposed under said fixing arm, said elastic plate switch including a first elastic plate and a second elastic plate, an end portion of said first elastic plate being above an end portion of said swing arm;

a biasing rod disposed on said fixing arm; and a knob attached to said biasing rod, said biasing rod operating said elastic plate switch by displacing said second elastic plate when said knob is operated, wherein a plurality of traverse stopping rods are provided under said first elastic plate of said switch such that said first elastic plate is prevented from downward movement caused by a change in temperature when contacting said traverse stopping rods.

* * * * *